US008398366B2

(12) United States Patent
Twell

(10) Patent No.: US 8,398,366 B2
(45) Date of Patent: Mar. 19, 2013

(54) ANNULAR VANE ASSEMBLY FOR A GAS TURBINE ENGINE

(75) Inventor: Philip Twell, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 563 days.

(21) Appl. No.: 12/700,054

(22) Filed: Feb. 4, 2010

(65) Prior Publication Data

US 2010/0196155 A1 Aug. 5, 2010

(30) Foreign Application Priority Data

Feb. 5, 2009 (EP) ..... 09152225

(51) Int. Cl.
*F03B 11/02* (2006.01)

(52) U.S. Cl. ..... 415/209.2; 415/209.3; 415/213.1

(58) Field of Classification Search ..... 415/191, 415/208.1, 208.2, 209.2, 209.3, 209.4, 210.1, 415/213.1; 416/190, 191, 215, 216, 218, 416/220 R, 248
See application file for complete search history.

(56) References Cited

U.S. PATENT DOCUMENTS

| | | | | |
|---|---|---|---|---|
| 3,326,523 | A * | 6/1967 | Bobo | 415/209.3 |
| 4,897,021 | A * | 1/1990 | Chaplin et al. | 415/173.7 |
| 5,927,942 | A * | 7/1999 | Stahl et al. | 415/115 |
| 7,291,946 | B2 * | 11/2007 | Clouse et al. | 310/51 |

FOREIGN PATENT DOCUMENTS

| | | |
|---|---|---|
| EP | 0616110 A1 | 9/1994 |
| FR | 2282550 A1 | 3/1976 |
| GB | 2250782 A | 6/1992 |

* cited by examiner

*Primary Examiner* — Ninh H Nguyen
*Assistant Examiner* — William Grigos

(57) ABSTRACT

An annular vane assembly for a gas turbine engine is provided. The assembly includes a vane segment, the vane segment includes an arcuate rail and a vane that extends radially inwardly from the arcuate rail. The assembly also includes a hollow cylindrical casing, the inside curved surface of which an annular groove is formed that receives the arcuate rail. The arcuate rail is secured in the annular groove using a resilient strip interposed between the rail and the groove. The resilient strip includes a planar main body and sprung wings that extend to either side of the main body. The wings are angled with respect to the plane of the main body. The resilient strip is moveable circumferentially between a first position in which the strip exerts a force radially on the arcuate rail and a second position in which the wings occupy recesses in the assembly.

10 Claims, 5 Drawing Sheets

ANNULAR VANE ASSEMBLY FOR A GAS TURBINE ENGINE

CROSS REFERENCE TO RELATED APPLICATIONS

This application claims priority of European Patent Office application No. 09152225.0 EP filed Feb. 5, 2009, which is incorporated by reference herein in its entirety.

FIELD OF INVENTION

This invention relates to an annular vane assembly for a gas turbine engine.

BACKGROUND OF INVENTION

More particularly, the invention relates to an annular vane assembly for a gas turbine engine, the assembly including a vane segment comprising an arcuate rail and at least one vane that extends radially inwardly from the arcuate rail, the assembly also including a hollow cylindrical casing in the inside curved surface of which is formed an annular groove for receiving the arcuate rail of the vane segment.

One known vane segment 1 is shown in FIG. 1*a*, and comprises a radially inner arcuate rail 3, a radially outer arcuate rail 5, and vanes 7 that extend radially between the inner and outer rails. The outer rail 5 has flanges 9 that run along either side of the rail. One known hollow cylindrical casing 11 is shown in FIG. 1*b*, and includes in its inside curved surface 13 a plurality of annular grooves 15. Each annular groove 15 has recesses 17 that run along either side of the groove.

The vane segment 1 of FIG. 1*a* is fitted to the casing 11 of FIG. 1*b* by aligning the ends of the flanges 9 of the outer rail 5 of the vane segment with the ends of the recesses 17 of an annular groove 15 of the casing, and sliding the flanges circumferentially around the recesses so that the outer rail slides circumferentially around the annular groove. FIG. 1*c* shows the mating relationship between the outer rail 5 and the annular groove 15 when the vane segment 1 is fitted to the casing 11.

The known annular vane assembly of FIGS. 1*a* to 1*c* is an assembly of a compressor of a gas turbine engine.

There are various mechanisms by which vane segment 1, once fitted to casing 11, can be secured in place.

One such mechanism is as shown in FIG. 1*c*. The flanges 9 are a tight fit within the recesses 17, i.e. there is a minimum clearance between the radially inwardly/outwardly facing surfaces of the flanges/recesses, thereby to hold the vane segment 1 at a predetermined position in the radial direction. This mechanism, although low cost, gives rise to problems in assembly if there has been minor distortion in the physical form of the vane segment during its fabrication. Also, if it is required to remove the vane segment from the casing following actual in service use of the gas turbine engine, then this can be very difficult due to corrosion and distortion of the vane segment during use.

Another mechanism is as shown in FIG. 2. The annular grooves 15 are formed by clamp rings 19 bolted to the inside curved surface 13 of the hollow cylindrical casing 11 by means of bolts (not shown) that pass via holes 21 from the outside of the casing to the clamp rings. Removal of vane segments is made easy by removal of the clamp rings. This mechanism, although solving the problems of the FIG. 1*c* mechanism, is expensive.

A further mechanism is shown in FIG. 3. The cross section of the annular groove 15 is such as to loosely fit the radially outer arcuate rail 5 of the vane segment 1, and a spring pack 23 is used to secure the flanges 9 of the rail 5 against the radially outwardly facing surfaces 25 of the recesses 17 of the groove 15. The spring pack 23 comprises a spring 27, a spring holder 29, and a jacking screw 31. Tightening of jacking screw 31 causes spring holder 29 to bear down upon flanges 9, clamping flanges 9 onto surfaces 25 with a controlled spring load. Vane segment 1 is now secured in position. In use temperature change may give rise to relative movement between constituent parts. The controlled spring load allows some such movement. Loosening of jacking screw 31 unclamps flanges 9, releasing vane segment 1 for removal from annular groove 15. Typically two or three spring packs 23 are used per vane segment. The mechanism of FIG. 3 suffers from the disadvantage that it is complex.

SUMMARY OF INVENTION

According to the present invention there is provided an annular vane assembly for a gas turbine engine, the assembly including a vane segment comprising an arcuate rail and at least one vane that extends radially inwardly from the arcuate rail, the assembly also including a hollow cylindrical casing in the inside curved surface of which is formed an annular groove for receiving the arcuate rail of the vane segment, the arcuate rail being secured in the annular groove by means of one or more resilient strips interposed between the rail and the groove, the or each resilient strip comprising a planar main body and sprung wings that extend to either side of the main body, the wings being angled with respect to the plane of the main body, the or each resilient strip being moveable circumferentially between (i) a first position in which the strip exerts a force radially on the arcuate rail to secure the rail in the annular groove and (ii) a second position in which the wings of the strip occupy recesses in the assembly to relieve the radial force and release the rail in the groove.

In an assembly according to the preceding paragraph, it is preferable that there is one resilient strip and in the first position it exerts a radially inward force on the arcuate rail.

In an assembly according to the preceding paragraph, it is preferable that the rail includes flanges that run along either side of the rail, and the groove includes recesses that run along either side of the groove, first surfaces comprising radially inwardly facing surfaces of the flanges engaging with second surfaces comprising radially outwardly facing surfaces of the recesses, and the resilient strip is interposed between third surfaces comprising radially outwardly facing surfaces of the flanges and fourth surfaces comprising radially inwardly facing surfaces of the recesses, in the first position (i) the wings of the strip exerting a radially inward force on the third surfaces and (ii) the main body of the strip exerting a radially outward force on the fourth surfaces.

It is preferable that an assembly according to the preceding paragraph further comprises a further strip interposed between the resilient strip and the third surfaces, in the first position the wings of the resilient strip exerting the radially inward force on the third surfaces via the agency of the further strip, the recesses in the assembly comprising recesses in each side of the further strip, the circumferential movement of the resilient strip between the first and second positions being circumferential movement relative to the further strip.

In an assembly according to the preceding paragraph, it is preferable that the recesses of the further strip include encountered sides that are encountered by the wings of the resilient strip when the resilient strip is moved circumferentially relative to the further strip from the second to the first positions, and wherein the encountered sides subtend an angle to the circumferential direction of substantially less than 90 degrees.

In an assembly according to either of the preceding two paragraphs, it is preferable that the ends of the resilient and/or further strips include a tooling hole whereby a tool can be attached to the resilient/further strip to facilitate the circumferential movement of the resilient strip relative to the further strip between the first and second positions.

In an assembly according to any one of the preceding six paragraphs, it is preferable that the arcuate rail and annular groove incorporate a complementary protrusion and depression to circumferentially locate the rail within the groove.

In an assembly according to any one of the preceding seven paragraphs, it is preferable that the or each vane of the vane segment extends radially inwardly to a further arcuate rail of the vane segment.

The assembly according to any one of the preceding eight paragraphs may be a compressor assembly.

BRIEF DESCRIPTION OF THE DRAWINGS

The invention will now be described, by way of example, with reference to the accompanying drawings, in which.

DETAILED DESCRIPTION OF INVENTION

Figure 1A:
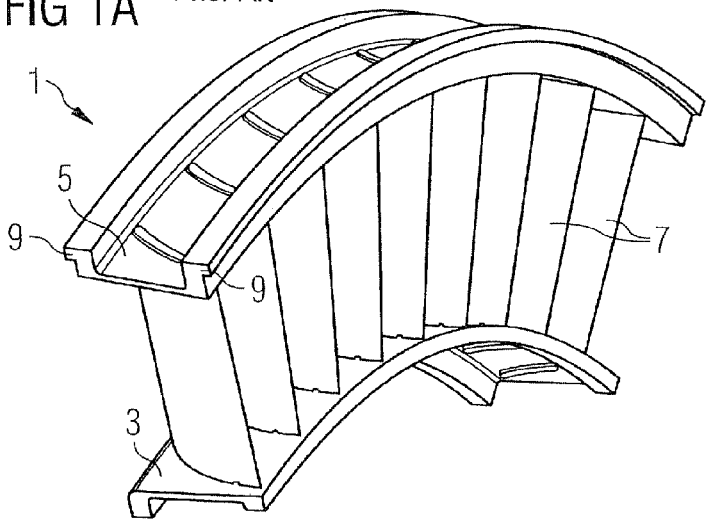
FIG 1A Prior Art
FIG. 1*a*, already referred to, is a perspective view of a known vane segment.
Figure 1B:
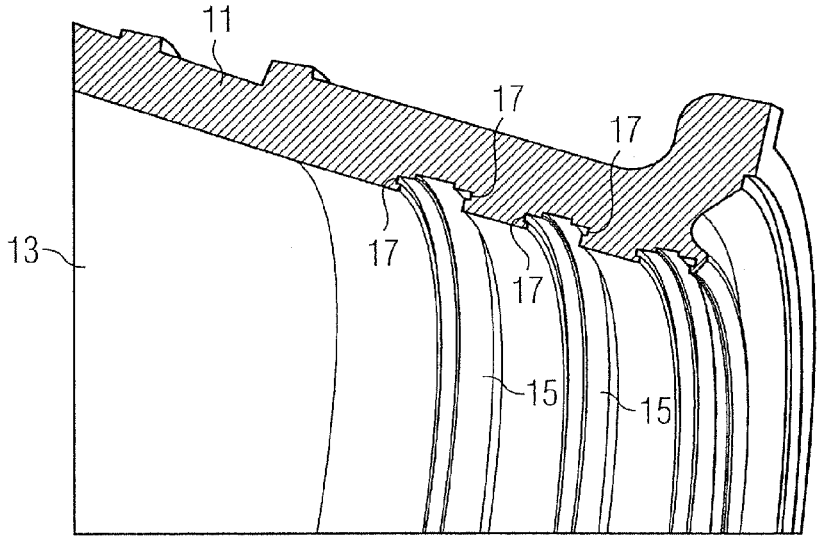
FIG 1B Prior Art
FIG. 1*b*, already referred to, is a perspective view of a known hollow cylindrical casing to which fits the known vane segment of FIG. 1*a;*
Figure 1C:
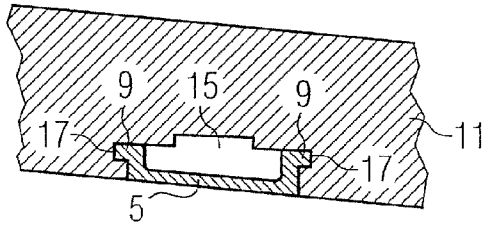
FIG 1C Prior Art
FIG. 1*c*, already referred to, shows a mating relationship between an outer rail of the vane segment of FIG. 1*a* and an annular groove of the casing of FIG. 1*b;*
Figure 2:
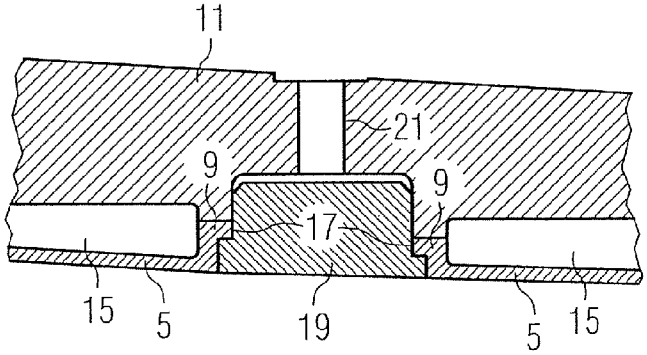
FIG 2 Prior Art
FIG. 2, already referred to, shows a mechanism by which a vane segment, once fitted to a casing, can be secured in place.
Figure 3:
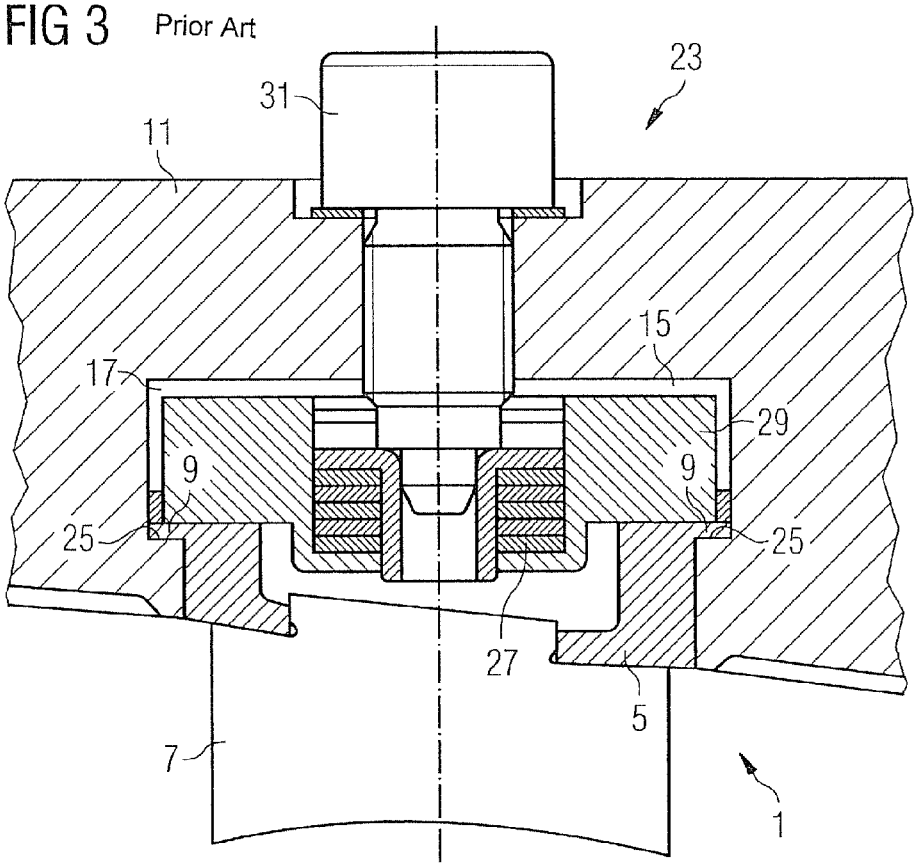
FIG 3 Prior Art
FIG. 3, already referred to, shows a further mechanism by which a vane segment, once fitted to a casing, can be secured in place.
Figure 4:
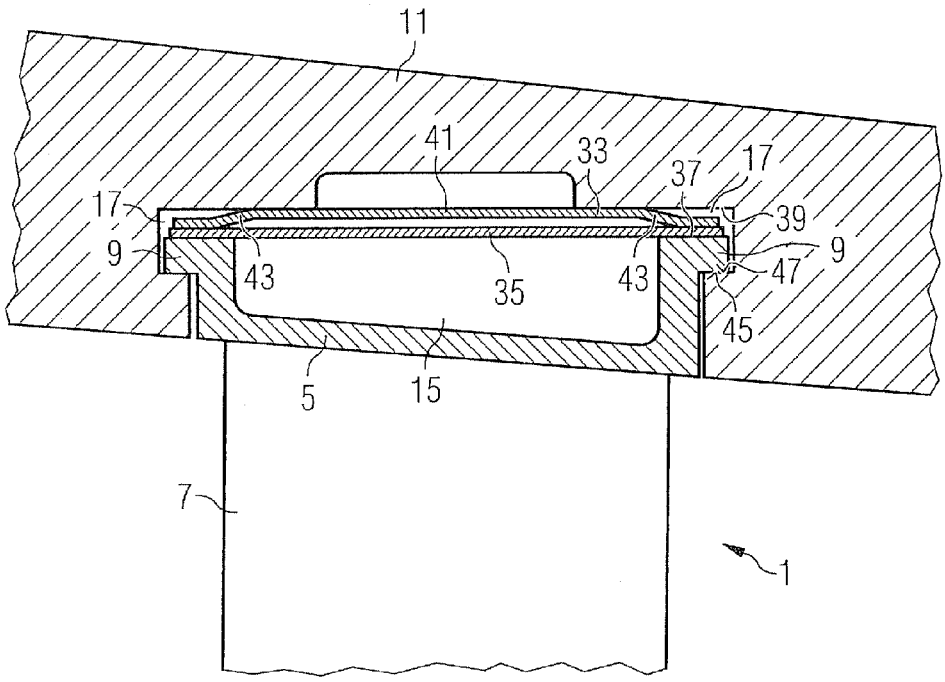
FIG. 4 shows a mechanism according to the present invention by which the vane segment of FIG. 1*a*, once fitted to the casing of FIG. 1*b*, can be secured in place.
Figure 5:
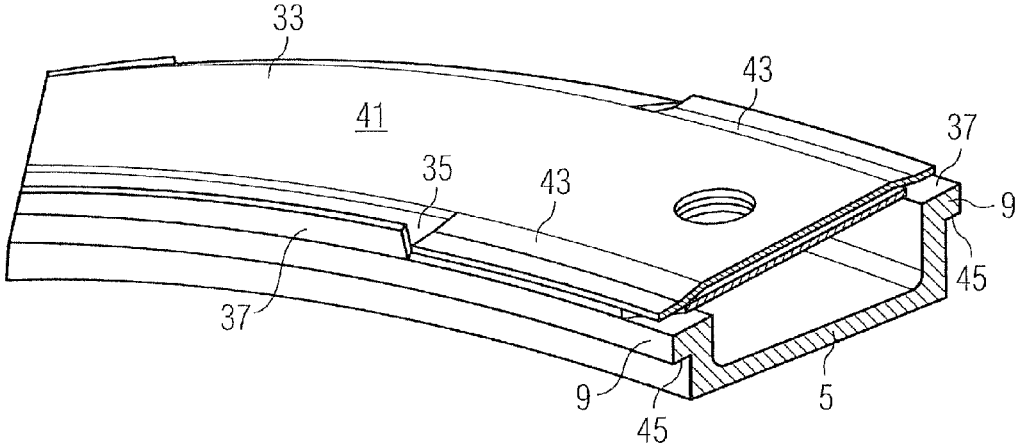
FIG. 5 is a partial perspective view showing resilient and further strips of FIG. 4 lying atop a rail of FIG. 4.

Referring to FIG. 4, vane segment 1 of FIG. 1*a* is fitted to hollow cylindrical casing 11 of FIG. 1*b* in precisely the manner described above (the ends of flanges 9 are aligned with the ends of recesses 17, and flanges 9 are slid circumferentially around recesses 17). In a manner described in more detail below, resilient and further strips 33, 35 are then inserted between radially outwardly facing surfaces 37 of flanges 9 and radially inwardly facing surfaces 39 of recesses 17. FIG. 5 shows strips 33, 35 lying atop flanges 9. In FIG. 5 casing 11 atop strips 33, 35 is not shown. Resilient strip 33 lies radially outwardly of further strip 35 and against surfaces 39. Further strip 35 lies radially inwardly of resilient strip 33 and against surfaces 37.

Resilient strip 33 comprises a planar main body 41 and sprung wings 43 that extend to either side of main body 41. Wings 43 are angled with respect to the plane of main body 41 such that (i) main body 41 exerts a radially outward force on surfaces 39, and (ii) wings 43 exert a radially inward force on further strip 35. Further strip 35 in turn exerts a radially inward force on surfaces 37. This causes radially inwardly facing surfaces 45 of flanges 9 to be biased against radially outwardly facing surfaces 47 of recesses 17, clamping flanges 9 onto surfaces 47. In this manner, vane segment 1 is securely held in position in annular groove 15 of casing 11.

Figure 6:
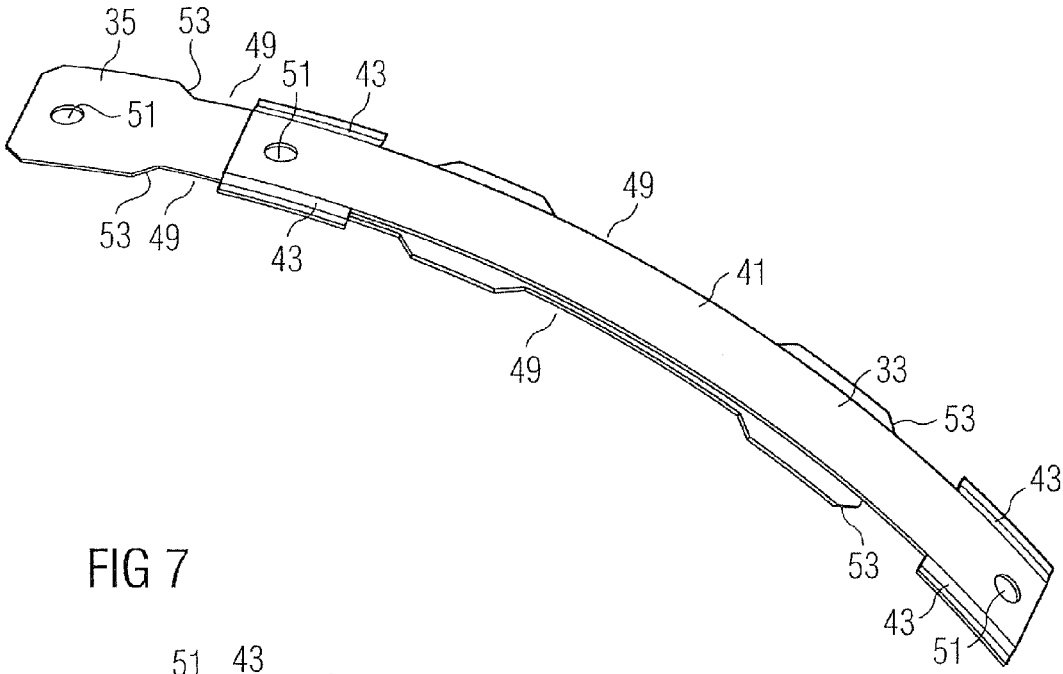
FIG. 6 is a perspective view of the resilient and further strips in a first positioning.
Figure 7:
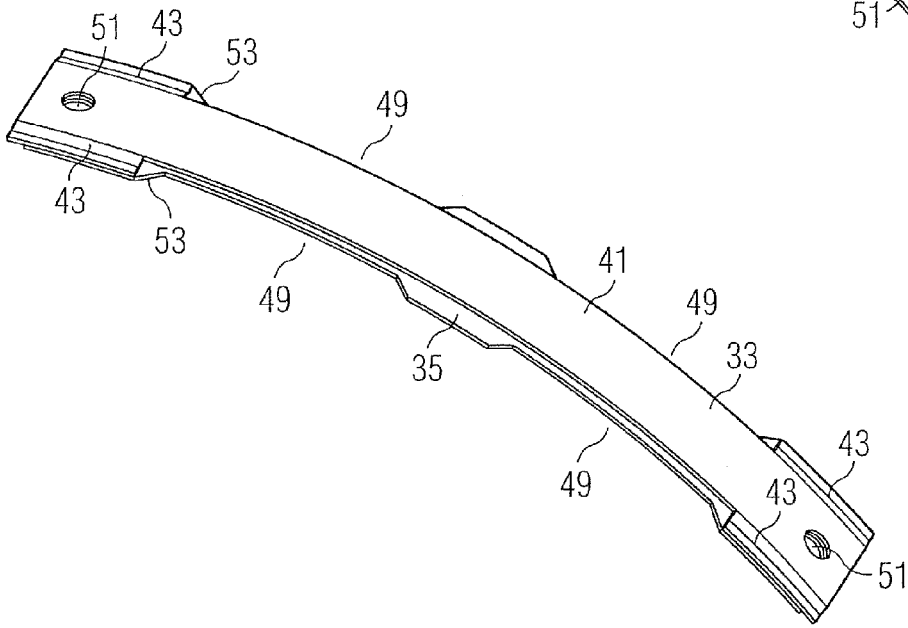
FIG. 7 is a perspective view of the resilient and further strips in a second positioning.

Referring to FIGS. 6 and 7, further strip 35 includes recesses 49 in either side. Recesses 49 come into play when strips 33, 35 are inserted between, or removed from insertion between, surfaces 37 of flanges 9 and surfaces 39 of recesses 17.

When insertion takes place, strips 33, 35 are positioned relative to one another as shown in FIG. 6. Strip 33 lies on top of strip 35 (radially outwardly of strip 35) but is displaced relative to strip 35 in the direction of the lengths of strips 33, 35 by a distance such that wings 43 of strip 33 occupy recesses 49 of strip 35 (or are displaced past an end of strip 35). The positioning of FIG. 6 is to be contrasted to the positioning of FIG. 7, where there has been no displacement of strip 33 in the direction of the lengths of strips 33, 35 (and the ends of strips 33, 35 are in register). It is the positioning of FIG. 7 that strips 33, 35 have when strips 33, 35 are in their in use positions between vane segment 1 and annular groove 15 of casing 11.

In the positioning of FIG. 6, with wings 43 occupying recesses 49 (or displaced past an end of strip 35), wings 43 do not engage strip 35 and therefore do not raise strip 33 away from strip 35 (in a radially outward direction). Thus, in the positioning of FIG. 6 the dimension of mated strips 33, 35 in the radial direction is reduced (as compared to the same dimension in the positioning of FIG. 7). This reduced dimension enables strips 33, 35 to be inserted relatively easily between surfaces 37 of flanges 9 and surfaces 39 of recesses 17.

Following insertion of strips 33, 35, strip 33 is slid circumferentially relative to strip 35 in order to bring strips 33, 35 to the positioning shown in FIG. 7. This brings wings 43 into engagement with strip 35, lifting strip 33 away from strip 35 (in a radially outward direction). The result is the clamping of vane segment 1 in place in annular groove 15, as described above with reference to FIGS. 4 and 5.

The removal of strips 33, 35 is the reverse of insertion. Thus, strip 33 is slid circumferentially relative to strip 35 to bring strips 33, 35 to the positioning of FIG. 6. Strips 33, 35 can then be removed relatively easily from between surfaces 37 of flanges 9 and surfaces 39 of recesses 17 (vane segment 1 can then be removed).

During insertion of strips 33, 35, strip 33 is slid circumferentially relative to strip 35 to bring wings 43 of strip 33 into engagement with strip 35. During removal of strips 33, 35 the reverse occurs. To assist in this sliding tooling holes 51 are provided in the ends of strips 33, 35 whereby an appropriate tool can be attached to strips 33, 35 to facilitate the sliding. The holes 51 of the two strips 33, 35 are of the same size, and, in the positioning of FIG. 7, concentric. To make easer the engagement of a tool with a selected one of the two strips 33, 35: (i) the relative location of the holes 51 in the two strips could be changed so that the holes are not concentric but are offset in the positioning of FIG. 7, or (ii) the size of the holes in the radially inner strip 35 could be made larger, or (iii) the holes in radially outer strip 33 could be dispensed with.

Recesses 49 of strip 35 include sides 53 that are encountered by wings 43 of strip 33 when transition is occurring from the positioning of FIG. 6 to the positioning of FIG. 7. To ease the riding-up of wings 43 onto strip 35, sides 53 subtend an angle to the circumferential direction of substantially less than 90 degrees.

Figure 8:
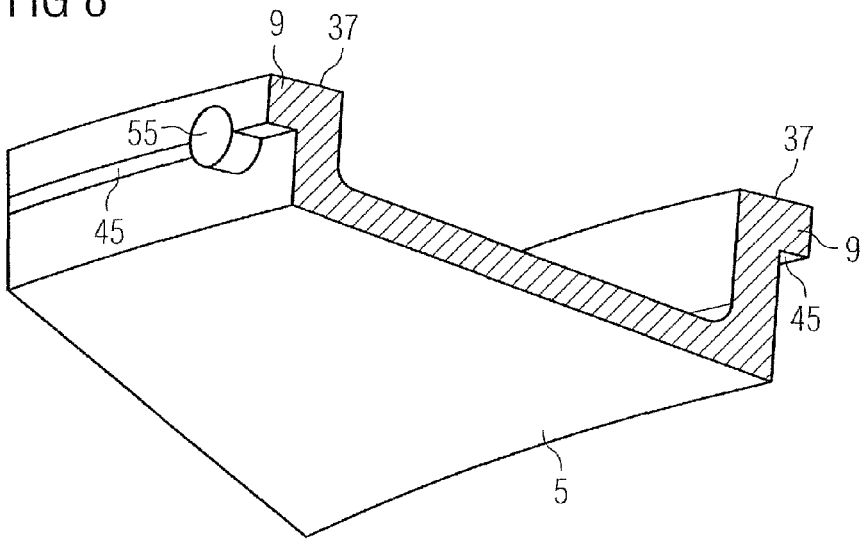
FIGS. 8 and 9 illustrate a complementary protrusion and depression incorporated in a rail and groove of FIG. 4.
Figure 9:
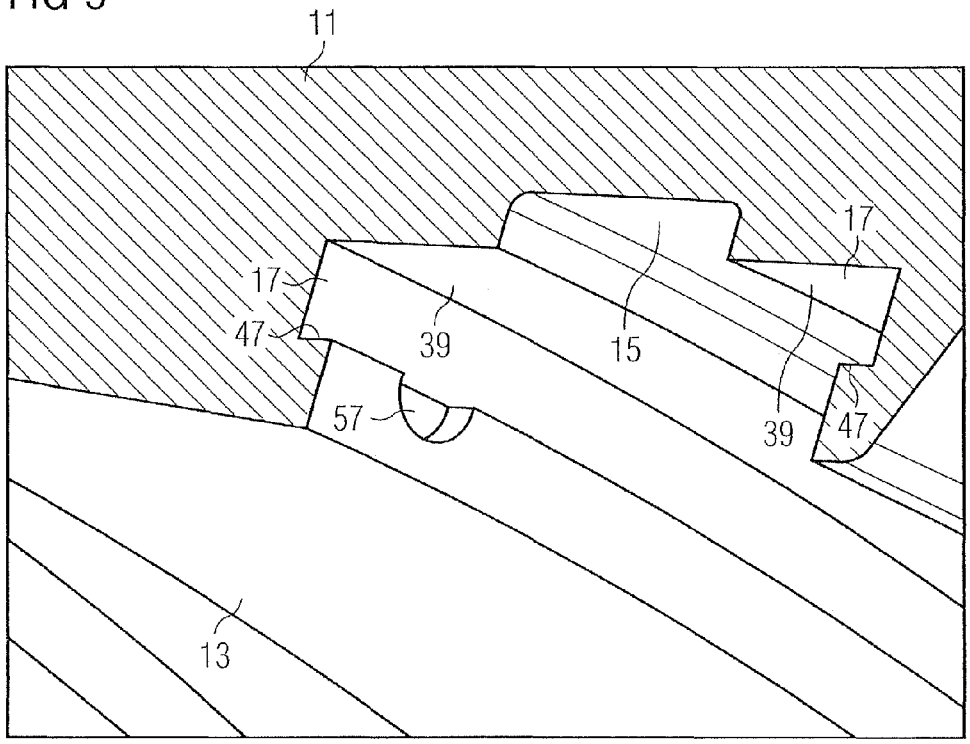

Referring to FIGS. 8 and 9, arcuate rail 5 of vane segment 1 and annular groove 15 of casing 11 incorporate a complementary protrusion 55 and depression 57 to circumferentially locate rail 5 within groove 15 prior to insertion of strips 33, 35.

In the above description two strips 33, 35 are used. It is to be appreciated that further strip 35 could be dispensed with, and the recesses 49 of further strip 35 formed instead in radially outwardly facing surfaces 37 of flanges 9 of rail 5. Resilient strip 35 would be slid into groove 15 at the same time as rail 5, with wings 43 of strip 35 occupying the recesses in surfaces 37. Once rail 5 is in the correct circumferential position then strip 35 would be slid circumferentially relative to rail 5 to bring wings 43 out of the recesses in surfaces 37 to a position where they bias against the remaining raised portions of surfaces 37. The reverse would occur in removal of vane segment 1.

In the above description one 35 or two 33, 35 strips are used between radially outwardly facing surfaces 37 of flanges 9 and radially inwardly facing surfaces 39 of recesses 17. It is to be appreciated that instead one or two pairs of strips could be used between radially outwardly facing surfaces 47 of recesses 17 and radially inwardly facing surfaces 45 of flanges 9, one strip of the or each pair being located at each side of rail 5. The one or two strips at each side of rail 5 would operate in corresponding manner to one strip 35 or two strips 33, 35.

The invention claimed is:

1. An annular vane assembly for a gas turbine engine, the assembly comprising:

a vane segment, the vane segment comprising:

an arcuate rail, and a vane that extends radially inwardly from the arcuate rail; and a hollow cylindrical casing including an inside curved surface in which an annular groove is formed and receives the arcuate rail of the vane segment, wherein the arcuate rail is secured in the annular groove using a resilient strip interposed between the arcuate rail and the annular groove, wherein the resilient strip comprises a planar main body and a plurality of sprung wings that extend to either side of the main body, wherein the plurality of sprung wings are angled with respect to a plane of the main body, and wherein the resilient strip is circumferentially moveable between a first position in which the resilient strip exerts a force radially on the arcuate rail in order to secure the arcuate rail in the annular groove and a second position in which the plurality of sprung wings occupy a first plurality of recesses in the assembly to relieve the radial force and release the arcuate rail in the annular groove.

2. The assembly as claimed in claim 1, wherein the resilient strip in the first position exerts a radially inward force on the arcuate rail.

3. The assembly as claimed in claim 2, wherein the arcuate rail includes a plurality of flanges that run along either side of the arcuate rail, wherein the annular groove includes a second plurality of recesses that run along either side of the annular groove, wherein a plurality of first surfaces comprising a radially inwardly facing surface of the plurality of flanges engages with a second surface comprising a radially outwardly facing surface of the second plurality of recesses, and wherein the resilient strip is interposed between a plurality of third surfaces comprising radially outwardly facing surfaces of the plurality of flanges and a plurality of fourth surfaces comprising radially inwardly facing surfaces of the second plurality of recesses, and wherein in the first position the plurality of sprung wings exert a radially inward force on the plurality of third surfaces and the main body of the resilient strip exerts a radially outward force on the plurality of fourth surfaces.

4. The assembly as claimed in claim 3, further comprising a further strip interposed between the resilient strip and the plurality of third surfaces, wherein in the first position the plurality of sprung wings exerts the radially inward force on the plurality of third surfaces via the further strip, wherein the first plurality of recesses includes a third plurality of recesses in each side of the further strip, and wherein a circumferential movement of the resilient strip between the first position and the second position is a circumferential movement relative to the further strip.

5. The assembly as claimed in claim 4, wherein the third plurality of recesses include a plurality of sides that are encountered by the plurality of sprung wings when the resilient strip is moved circumferentially relative to the further strip from the second position to the first position, and wherein the plurality of sides subtend an angle to a circumferential direction of substantially less than 90 degrees.

6. The assembly as claimed in claim 5, wherein a plurality of ends of the resilient strip and/or the further strip include a tooling hole whereby a tool may be attached to the resilient strip and/or the further strip to facilitate the circumferential movement of the resilient strip relative to the further strip between the first position and the second position.

7. The assembly as claimed in claim 4, wherein a plurality of ends of the resilient strip and/or the further strip include a tooling hole whereby a tool may be attached to the resilient strip and/or the further strip to facilitate the circumferential movement of the resilient strip relative to the further strip between the first position and the second position.

8. The assembly as claimed in claim 1, wherein the arcuate rail and the annular groove incorporate a complementary protrusion and a depression to circumferentially locate the arcuate rail within the annular groove.

9. The assembly as claimed in claim 1, wherein each vane of the vane segment extends radially inwardly to a further arcuate rail of the vane segment.

10. The assembly as claimed in claim 1, wherein the assembly is a compressor assembly.

* * * * *